US008991657B2

(12) United States Patent
Ciavarella et al.

(10) Patent No.: US 8,991,657 B2
(45) Date of Patent: Mar. 31, 2015

(54) FOAM SOAP DISPENSER WITH STATIONARY DISPENSING TUBE

(71) Applicants: Nick E. Ciavarella, Seven Hills, OH (US); David D. Hayes, Wooster, OH (US)

(72) Inventors: Nick E. Ciavarella, Seven Hills, OH (US); David D. Hayes, Wooster, OH (US)

(73) Assignee: GOJO Industries, Inc., Akron, OH (US)

( * ) Notice: Subject to any disclaimer, the term of this patent is extended or adjusted under 35 U.S.C. 154(b) by 24 days.

(21) Appl. No.: 14/012,639

(22) Filed: Aug. 28, 2013

(65) Prior Publication Data

US 2013/0341358 A1 Dec. 26, 2013

Related U.S. Application Data

(62) Division of application No. 11/728,557, filed on Mar. 26, 2007, now Pat. No. 8,544,698.

(51) Int. Cl.

| | |
|---|---|
| ***B67D 7/76*** | (2010.01) |
| ***A47K 5/14*** | (2006.01) |
| ***B05B 7/00*** | (2006.01) |
| ***B05B 11/00*** | (2006.01) |
| *A47K 5/12* | (2006.01) |

(52) U.S. Cl.

CPC ..... *A47K 5/14* (2013.01); *B05B 7/0025* (2013.01); *B05B 11/3032* (2013.01); *B05B 11/3087* (2013.01); *B05B 11/3097* (2013.01); *A47K 2005/1218* (2013.01)

USPC ..... 222/190; 222/145.5; 222/173; 222/180; 222/207; 222/321.7; 222/382; 222/464.1

(58) Field of Classification Search

CPC ..... B05B 11/3032; B05B 7/0037; B05B 11/3087; B29B 7/7663; B29B 7/7678; B05C 17/00553; B05C 17/00516

USPC ..... 222/190, 145.5–145.6, 173, 180, 207, 222/209, 135, 382, 464.1, 189.1, 189.11, 222/321.7; 239/330; 261/DIG. 26, DIG. 28

See application file for complete search history.

(56) References Cited

U.S. PATENT DOCUMENTS

| | | | |
|---|---|---|---|
| 4,880,161 | A | 11/1989 | Wright |
| 4,957,218 | A | 9/1990 | Ford, Jr. |

(Continued)

FOREIGN PATENT DOCUMENTS

| | | |
|---|---|---|
| JP | 08038381 | 2/1996 |
| WO | 2005/068084 | 7/2005 |
| WO | 2007/042794 | 4/2007 |

OTHER PUBLICATIONS

JP08-038381 English translation, Dated Feb. 1996.

(Continued)

*Primary Examiner* — Frederick C Nicolas

(74) *Attorney, Agent, or Firm* — Calfee, Halter & Griswold LLP

(57) ABSTRACT

Dispensers are provided including pumps for dispensing a foamed product out of an outlet provided in a dispensing tube. The foam is created from the mixing of a foamable liquid and air, with separate pumps being provided for each component. The dispensing tube is stationary, although the pumps themselves have parts that must move to dispense the foamed product. A single actuator operates both the liquid and air pumps. Additionally, in some embodiments, the air pump advances air before the liquid pump advances liquid. These pumps are particularly suited to the dispensing of a foamed skin care or skin sanitizing product.

20 Claims, 6 Drawing Sheets

(56) References Cited

U.S. PATENT DOCUMENTS

| | | | |
|---|---|---|---|
| 5,451,104 | A | 9/1995 | Kleen et al. |
| 5,462,208 | A | 10/1995 | Stahley et al. |
| 5,520,337 | A | 5/1996 | Fuchs |
| 5,544,788 | A | 8/1996 | Meyer |
| 5,862,954 | A | 1/1999 | Ehrensperger et al. |
| 5,984,146 | A | 11/1999 | Kaufman |
| 5,993,180 | A | 11/1999 | Westerhof et al. |
| 6,626,332 | B2 | 9/2003 | Ehrensperger et al. |
| 7,364,053 | B2 | 4/2008 | Ophardt |
| 7,431,182 | B2 | 10/2008 | Ciavarella |
| 7,455,197 | B2 | 11/2008 | Ophardt |
| 7,819,289 | B2 | 10/2010 | Willis |
| 8,002,151 | B2 | 8/2011 | Matthews et al. |
| 8,544,698 | B2 | 10/2013 | Ciavarella et al. |
| 2004/0069807 | A1 | 4/2004 | Brouwer et al. |
| 2005/0139612 | A1 | 6/2005 | Matthews et al. |
| 2005/0258192 | A1 | 11/2005 | Matthews et al. |
| 2005/0271599 | A1 | 12/2005 | Matthews et al. |
| 2006/0011655 | A1 | 1/2006 | Ophardt |
| 2006/0108380 | A1 | 5/2006 | Ciavarella |
| 2007/0023454 | A1 | 2/2007 | Ophardt |
| 2007/0241137 | A1 | 10/2007 | Willis et al. |
| 2007/0278247 | A1 | 12/2007 | Banks et al. |
| 2009/0101679 | A1* | 4/2009 | Muderlak ..... 222/375 |
| 2010/0089951 | A1 | 4/2010 | Yates |
| 2010/0127018 | A1 | 5/2010 | Laidler et al. |
| 2010/0140300 | A1* | 6/2010 | Lewis et al. ..... 222/321.3 |

OTHER PUBLICATIONS

Taiwan Search Report and English Translation from Taiwanese Patent Application No. 097100575, dated Dec. 5, 2013.

Office Action from Canadian Patent Application No. 2,617,593 dated Feb. 5, 2014.

* cited by examiner

FOAM SOAP DISPENSER WITH STATIONARY DISPENSING TUBE

RELATED APPLICATIONS

This application claims priority to and the benefits of U.S. Non-Provisional patent application Ser. No. 11/728,557 filed on Mar. 26, 2007 and entitled FOAM SOAP DISPENSER WITH STATIONARY DISPENSING TUBE, which incorporated herein by reference in its entirety.

TECHNICAL FIELD

The invention herein resides in the art of soap dispensers. In particular embodiments, the invention relates to a foam soap dispensing system mounted to a counter, wherein a foam soap pump is mounted under a counter and receives a liquid soap container.

BACKGROUND OF THE INVENTION

The use of soap dispensers continues to grow as the awareness for the need for good hand hygiene practices grows. Numerous types of dispensing systems are known, including portable, hand held dispensers, wall mounted dispensers, and counter mounted dispensers. Typically, these soap dispensers dispense a predetermined amount of liquid soap upon actuation. Over the past decade or so, interest has grown in foam soap 15 dispensers, wherein air and liquid soap are mixed to form and dispense substantially homogenous foam.

Inline actuated foam soap dispensers are of particular interest because they have a number of drawbacks that can be improved upon. These dispensers include an actuator that is pressed to compress air and soap chambers to force air and soap through a mixing chamber to create foam. The foam is then forced through a dispensing spout. The dispensing tube is coupled to the actuator that is reciprocated to dispense the foam, and thus the dispensing tube moves as the actuator is pressed to dispense product and as it returns to its rest position. These dispensers work satisfactorily in the hand held dispenser embodiments, because the dispensing tube and the spout through which the foam is dispensed are formed in the actuator, and the user can simply place a hand under the spout to catch the foam dispensed therethrough even though the dispensing tube and spout move during dispensing. However these dispensers present problems in a counter mounted environment in which the dispensing tube and spout are decoupled from the actuator.

In the counter mounted dispenser, a liquid soap source is mounted under a counter top and coupled to pumping mechanisms to deliver soap or foam at an outlet of a dispensing tube that extends through a rigid, stationary spout provided above the counter, preferably at a sink basin. The actuator for the dispenser is located proximate the spout and is pressed to dispense foam through the outlet of the dispensing tube. Pressing on the actuator causes air and liquid soap pumps to advance air and soap to be mixed and forced through the dispensing tube. The dispensing tube is coupled to the pump mechanisms such that, as the actuator is reciprocated to cause the pump mechanisms to compress and expand, the dispensing tube reciprocates within the spout. The reciprocation of the dispensing tube within the spout uses up energy in a dispenser that reciprocates the pumps electronically, and requires a larger amount of force to actuate by hand in a manually actuated dispenser.

Most counter mounted soap dispensers also create foam below the counter, proximate the soap and air pump mechanisms, and then force the foam up through a significant length of dispensing tube. This creates a few problems. First, the foam can degrade as it travels through the dispensing tube, yielding a poorer foam product. Second, pushing foam through a length of dispensing tube requires more force than pushing separate air and liquid soap sources, and this makes the actuator for the soap dispenser more difficult to push and, in the case of an electronically activated automatic soap dispenser, requires additional electric power. Published patent application 2006/0011655 shows a counter mounted soap dispenser that creates foam at the spout rather than proximate the pumping mechanisms under the counter, but it is focused solely on a system with separate electronic soap and air pumps and is not structurally similar to inline actuated soap dispensers.

Thus, there exists a need in the art for a foam pump wherein the dispensing tube is stationary during the dispensing of foam and during the refill of the pump with air and liquid. The pumps and dispensers herein will be found suitable for the dispensing of a variety of single or multi-component products. This need is particularly strong in the counter mount environment. This need exists specifically in the dispensing arts for skin care and skin sanitizing products, and, more specifically, the dispensing of foamed soaps and foamed sanitizing products.

SUMMARY OF THE INVENTION

In one embodiment, this invention provides a dispenser having a stationary dispensing tube, i.e., the dispensing tube does not move upon actuation of the dispenser to dispense product. The dispenser includes a liquid container holding a liquid, a compressible liquid chamber compressible to a compressed volume and biased to expand to an expanded volume, and a dip tube extending from the compressible liquid chamber into the liquid in the liquid container, wherein compression of the compressible liquid chamber forces liquid within the compressible liquid chamber into the stationary dispensing tube, and expansion of the compressible liquid chamber draws the liquid up through the dip tube and into the compressible liquid chamber. The dispenser further includes a compressible air chamber compressible to a compressed volume and biased to expand to an expanded volume, and an air passage communicating between the compressible air chamber and the stationary dispensing tube, wherein compression of the compressible air chamber forces air within the compressible air chamber into the stationary dispensing tube, and expansion of the compressible air chamber draws air into the compressible air chamber.

In accordance with another embodiment, this invention provides a dispenser that includes a mixing chamber, a compressible liquid chamber, a compressible air chamber, and a dual actuator. The compressible liquid chamber contains a liquid and is adapted to selectively reciprocate between an expanded volume and a compressed volume. The compressible liquid chamber advances the liquid to the mixing chamber when selectively moved to the compressed volume. The compressible air chamber contains air and is adapted to selectively reciprocate between an expanded volume and a compressed volume. The compressible air chamber advances air to the mixing chamber when selectively moved to the compressed volume. The dual actuator is selectively moved to compress both the compressible liquid chamber and the compressible air chamber to their compressed volumes, wherein upon such movement of the dual actuator, the air chamber begins to be compressed prior to the beginning of the compression of the liquid chamber.

DESCRIPTION OF DRAWINGS

For a complete understanding of the structure and techniques of the invention, reference should be made to the following detailed description and accompanying drawings wherein.

DETAILED DESCRIPTION OF THE INVENTION

Figure 1:
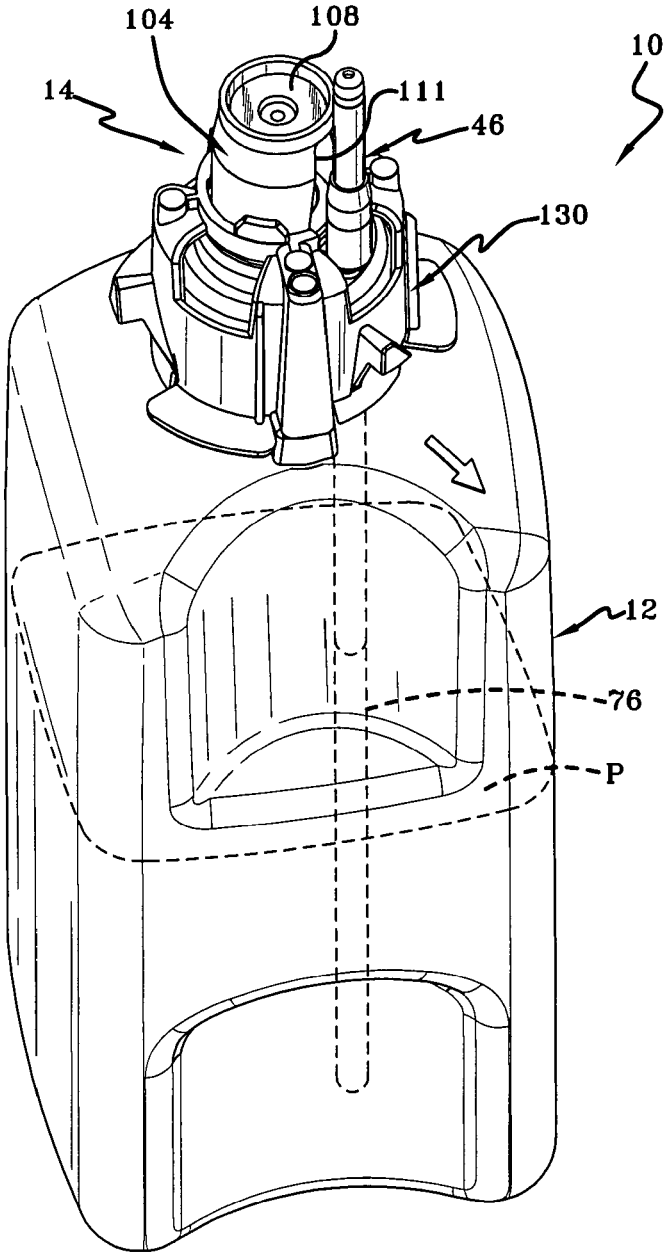
FIG. 1 is a general perspective view of a dispenser in accordance with this invention.
Figure 2:
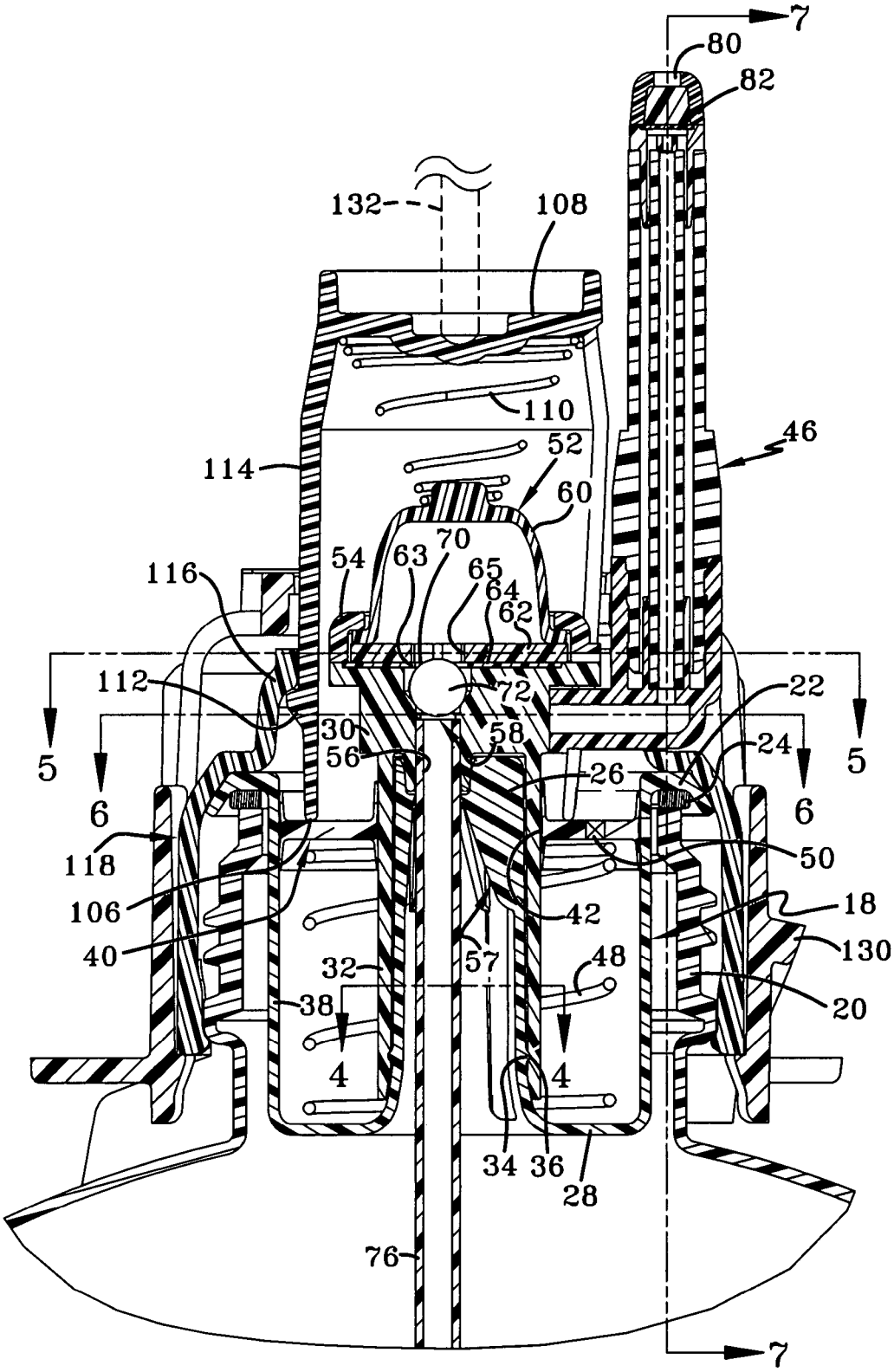
FIG. 2 is a cross section representation of the components of the dispenser taken along a line through the dip tube 76 and dispensing tube 46.
Figures 3, 4:
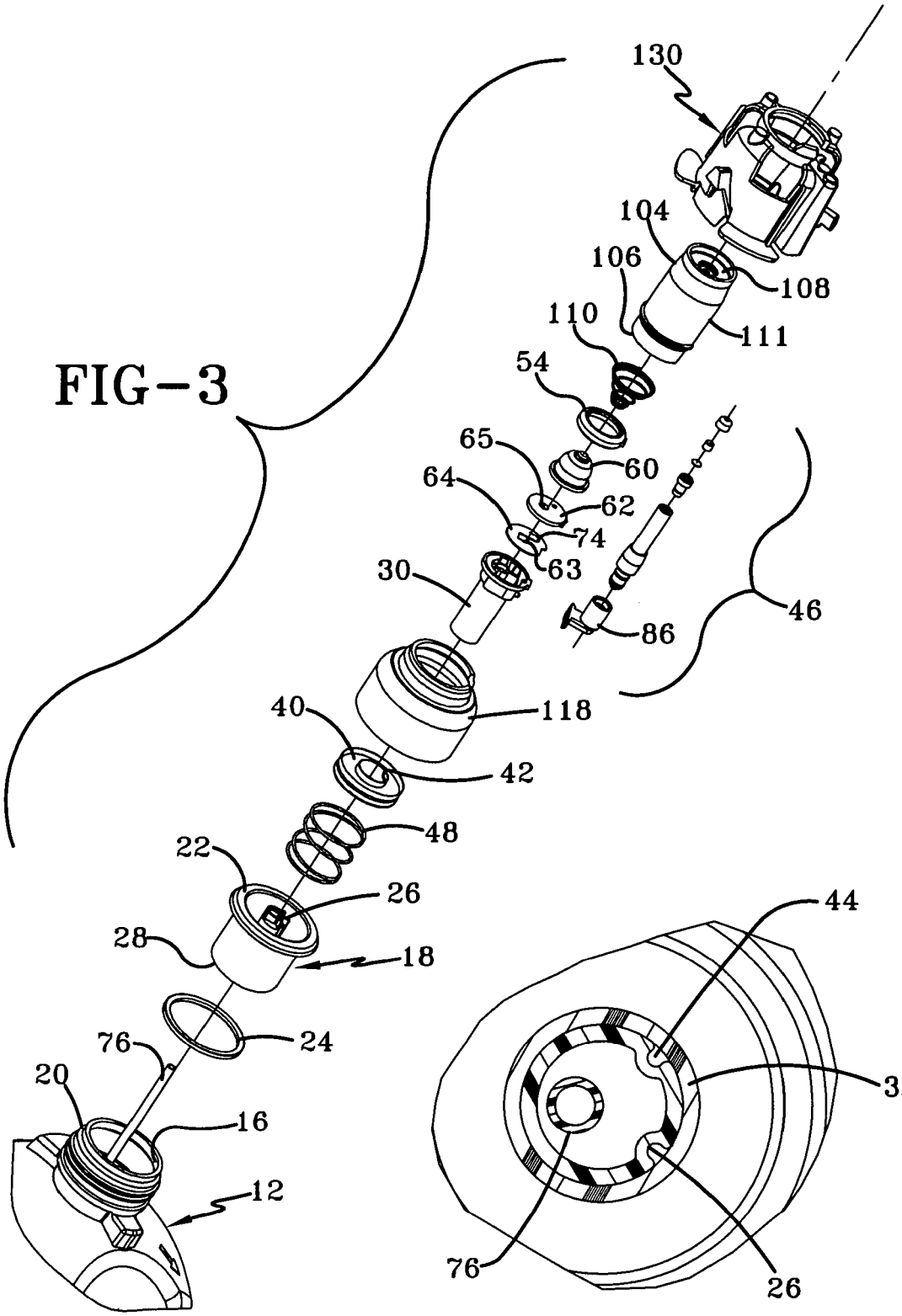
FIG. 3 is an assembly diagram of the dispenser.
FIG. 4 is a cross section along the line 4-4 of FIG. 2, showing the axial support 40 and its air channel 44.

Referring now to FIGS. 1-3, an embodiment of a dispenser in accordance with this invention is shown and designated by the numeral 10. Dispenser 10 includes product container 12, which holds product P to be dispensed through actuation of a foam pump mechanism 14. Generally, the product P held within container 12 will be a liquid or other substance that can be pumped against gravity to be dispensed.

Foam pump mechanism 14 fits into container 12 at open end 16. Referring to FIGS. 2 and 3, foam pump mechanism 14 includes compressible air chamber 18, which is received in threaded neck 20 of container 12, resting on upper radial flange 22, preferably with a container gasket 24 between flange 22 and the open end 16 of threaded neck 20. Container gasket 24 serves to prevent liquid from leaking out during shipping and handling of the container 12. An axial support 26 extends upwardly from bottom wall 28 of air chamber 18. Axial support 26 receives liquid pump support 30 fitting axially thereover with sidewall 32 of liquid pump support 30 extending down the sides of axial support 26 and snapping into place on axial support 26 as at annular rib 34 and annular detent 36. Thus an annular volume for air chamber 18 is defined between sidewall 38 of air chamber 18 and sidewall 32 of liquid pump support 30. The annular volume is further defined by air piston 40, which includes an aperture 42 for fitting over axial support 26. Air piston 40 intimately contacts sidewall 32 and sidewall 38 such that the contact is substantially air tight. However, as best seen in FIG. 4, axial support 26 includes an axial trough defining air channel 44 between the outer surface of axial support 26 and the inner surface of sidewall 32 of liquid pump support 30. Air channel 44 communicates with the volume of air in air chamber 18 and ultimately fluidly communicates with dispensing tube 46 through a path in liquid pump support 30.

Compressible air chamber 18 contains air and is adapted to selectively reciprocate between an expanded volume and a compressed volume. A biasing member 48 forces air piston 40 to a rest position defining an expanded volume for air chamber 18. Compressible air chamber 18 is compressed by forcing air piston 40 against biasing member 48, and a compressed volume is reached. This causes air to be forced through air channel 44 and ultimately into dispensing tube 46. By relaxing the force against biasing member 48, air piston 40 returns to its rest position, reestablishing the expanded volume. As air piston 40 returns to its rest position, air is pulled in back through dispensing tube 46 to fill the expanding volume of air chamber 18, i.e., air is pulled into air chamber 18 through a path opposite to the path the air takes when forced out of air chamber 18. This can help prevent dripping at the spout outlet, as will be described more fully herein below. Optionally, a one-way air valve such as that represented at the numeral 50 can be placed on air piston 40 or elsewhere communicating with air chamber 18.

Compressible liquid chamber 52 is sealed to liquid pump support 30 through retaining ring 54. Dip tube 76 extends through dip tube channel 56 in liquid pump support 30 and through axial channel 57 in axial support 26 to communicate between the volume of container 12 and that of compressible liquid chamber 52 through ball valve 58. More particularly, compressible liquid chamber 52 is formed of a flexible diaphragm 60, which is secured to axial support 26 over valve plate 62 and valve film 64. The volume of compressible liquid chamber 52 may be filled with a sponge material, if desired, to take of some of the volume and help the chamber recover from compression. Valve plate 62 includes inlet aperture 65 and outlet aperture 66 (FIG. 5), with inlet aperture 65 being aligned with dip tube channel 56 and outlet aperture 66 being aligned with liquid channel 68 (FIG. 6) in liquid pump support 30. Valve film 64 includes has an opening 63 (FIG. 3) aligned with inlet aperture 65, and these perforations 70 serve to allow liquid to pass into compressible liquid chamber 52, past the ball 72 of ball valve 58. Valve film 64 also includes a flap valve 74 (FIG. 3) aligned with outlet aperture 66, and flap valve 74 serves to allow liquid to pass into liquid channel 68 in liquid pump support 30. The actual movement of the liquid, into compressible liquid chamber 52 through dip tube 76 and dip tube channel 54, and out of compressible liquid chamber 52 15 through outlet aperture 66, is based upon the compression and expansion of the volume of compressible liquid chamber 52.

Figure 5:
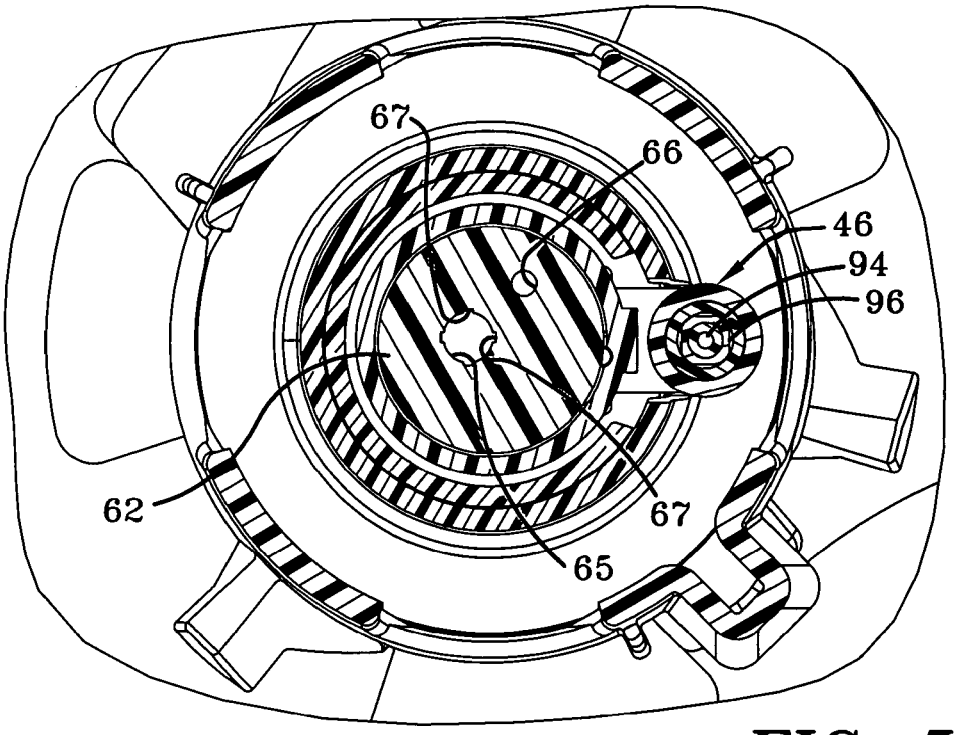
FIG. 5 is a cross section along the line 5-5 of FIG. 2, showing the valve plate 62 associated with the compressible liquid chamber 52.

Flexible diaphragm 60 is made from a resilient material that naturally rests in the position shown in FIG. 2, having an expanded volume. Thus, as is generally known, compressible liquid chamber 52 can selectively reciprocate between an expanded volume and a compressed volume. Compressible liquid chamber 52 is compressed by pressing on flexible diaphragm 60, and a compressed volume is reached. This compression of compressible liquid chamber 52 causes liquid held therein to be forced through outlet aperture 66 and ultimately into and through dispensing tube 46. Flap valve 74 is a cut out portion of valve film 64 positioned below outlet aperture 66, as seen in FIG. 3, and it bends to allow liquid to pass therethrough. During compression, liquid is prevented from moving into dip tube 76 because ball 72 contacts and seals off dip tube channel 56 where it narrows at sloped walls 78. Thus a dose of liquid is forced through outlet aperture 66 and flap valve 74 and toward dispensing tube 46 during compression of compressible liquid chamber 52. By relaxing the pressure on flexible diaphragm 60, it returns to its natural, expanded volume rest position and, while doing so, draws liquid up through dip tube 76, past ball 72 and into compressible liquid chamber 52. More particularly, as seen in FIG. 5, inlet aperture 65 has notches 67 that permit the passage of liquid past ball 72 even though it contacts inlet aperture 65 as it is drawn upward by the suction created at liquid chamber 52, i.e. the notches stick out beyond the ball 72 and the remainder of the inlet aperture 65 holds the ball 72. During expansion, liquid is prevented from being drawn back in at outlet aperture 66 because outlet aperture 66 is smaller than flap valve 74 and thus prevents flap valve 74 from flipping upward to permit liquid to pass therethrough.

As an alternative, the function of ball valve 58 could be replaced with an inlet flap valve in valve film 64 overlying an inlet aperture in valve plate 62. This would provide flow control into and out of compressible liquid chamber 52. Also, flexible diaphragm 60 could be a more rigid chamber and piston design, such as that shown for the compressible air chamber herein.

Thus far, liquid and air have been described to advance from their respective sources, i.e., compressible air chamber 18 and compressible liquid chamber 52, and ultimately into dispensing tube 46. The paths taken by the liquid and air are now more particularly disclosed. First, it should be appreciated that dispenser 10, upon first being constructed, will have liquid product P in container 12, and compressible liquid chamber 52 will be empty. With repeated compression and expansion of compressible liquid chamber 52, liquid product will be incrementally advanced up through dip tube 76 and into compressible liquid chamber 52, with an incremental advancement being dependent upon the difference in volume of compressible liquid chamber 52 between its compressed and expanded state. Once compressible liquid chamber 52 is filled, compression thereof will begin to advance liquid toward dispensing tube 46 and ultimately the outlet 80 at the tip of spout 82. The advancement toward outlet 80 will also be incremental. After a number of repetitive compressions and expansions, the entire liquid path through dip tube 76 to outlet 80 will be filled with liquid product P, and each compression of compressible liquid chamber 52 will expel a dose of liquid product at outlet 80. Although dispenser 10 will have an air path completely filled with air upon construction, is should still be appreciated that the air, like liquid product P, will be advanced incrementally through dispenser 10 along its path under the compression of compressible air chamber 18. As already disclosed, as compressible air chamber expands, air will incrementally suck back through outlet 80 and reverse along is path toward the expanding volume of compressible air chamber 18. With this understanding, the paths for air and liquid toward outlet 80 are next disclosed.

Figure 6:
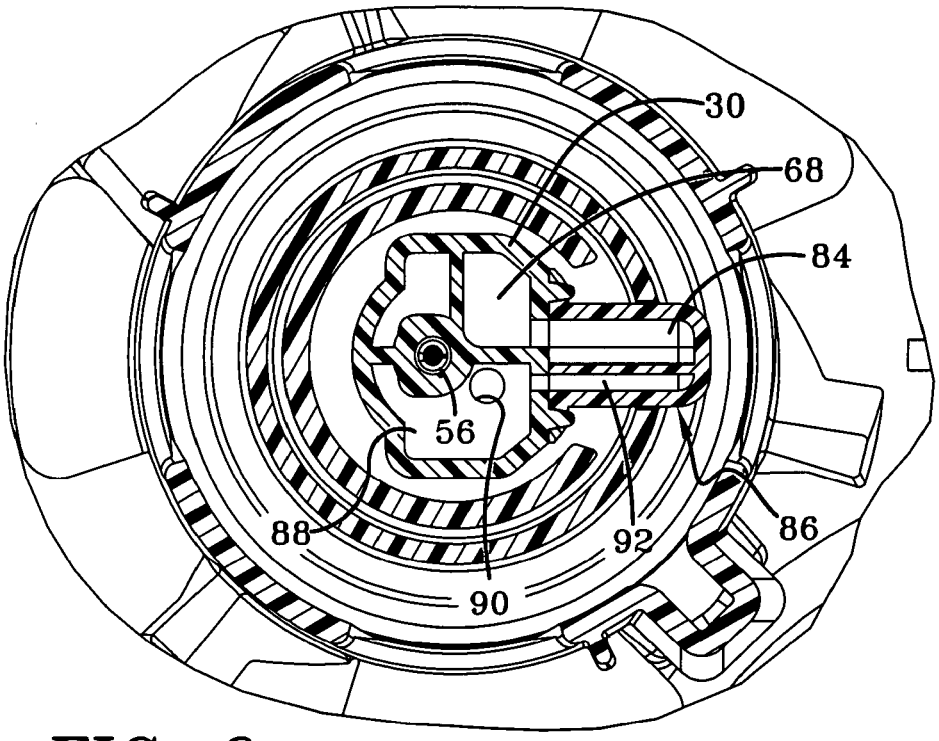
FIG. 6 is a cross section along the line 6-6 of FIG. 2, showing the liquid pump 15 support 30 and its liquid channel 68 and air channel 88.
Figure 7:
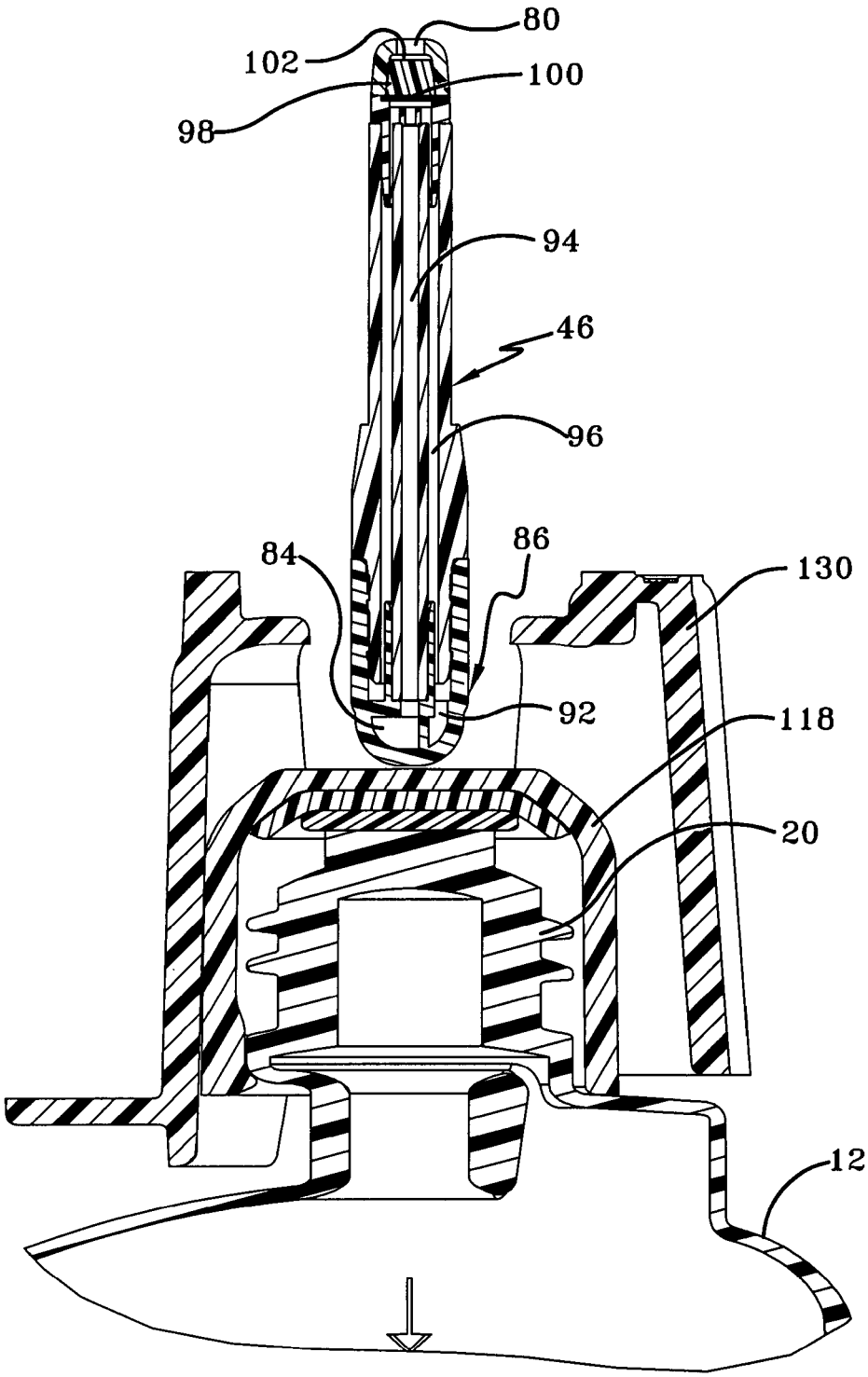
FIG. 7 is a cross section along the line 7-7 of FIG. 2, showing the communication of elbow 86 and its communication between liquid pump support 30 and dispensing tube 46, and also showing the coaxial tube construction of dispensing tube 46.

Referring to FIGS. 5-7, liquid exits compressible liquid chamber 52 through outlet aperture 66 and flap valve 74 and enters radial liquid channel 68 in liquid pump support 30. Liquid channel 68 extends radially to communicate with liquid path 84 in elbow 86. Axial air channel 44 communicates with radial air channel 88, through aperture 90 in liquid pump support 30, and parallels liquid channel 68 to communicate with air path 92 in elbow 86. Air and liquid are thus still separate in dispenser 10. Through their respective paths 84, 92, in elbow 86, liquid and air next communicate with dispensing tube 46, which is preferably constructed to keep the air and liquid separate until just proximate outlet 80.

With reference to FIG. 7, it can be seen that dispensing tube 46 is defined by coaxial tubes, a central liquid dispensing tube 94 and an outer annular air dispensing tube 96. Liquid dispensing tube 94 communicates with liquid path 84, and air dispensing tube 96 communicates with air path 92. Both tubes 94 and 96 terminate at mixing chamber 98, which is bounded by inlet mesh 100 and outlet mesh 102. Outlet mesh 102 preferably defines outlet 80 or is located very close to outlet 80. In this way, the air and liquid are kept separate as they are advanced to the outlet 80. This makes dispenser 10 easier to operate, because less force is needed to advance the separate air and liquid streams than would be required to advance foam through dispenser 10, were it created directly proximate outlets of the compressible air chamber and compressible liquid chamber, as is generally practiced in the prior art.

Referring back to FIGS. 2 and 3, dispenser 10 is operated through either manual or electronic movement of dual actuator 104. Dual actuator 104 is shown as a cylindrical piston member sized to have a diameter that permits its movement within the radial confines of compressible air chamber 18. Its bottom edge 106 contacts piston 40 of compressible air chamber 18, and its top wall 108 overlies compressible liquid chamber 52, preferably with a compression delay element 110 therebetween, as shown. Dual actuator 104 includes a cut-out portion 111 in its sidewall 114 for permitting the extension of elbow 86 radially outwardly of dual actuator 104. A stop rib 112 extending from sidewall 114 engages lip 116 of cap 118 to retain dual actuator 104 in a rest position against the force of biasing member 48.

Dual actuator 104 is moved against the bias force of biasing member 48 (and also compression delay element 110) to compress both compressible air chamber 18 and compressible liquid chamber 52. This advances doses of air and liquid through the dispenser 10 as already described, thus making foam at mixing chamber 98, exiting at outlet 80, through a stationary dispensing tube 46. Pressing down on dual actuator 104 presses down on flexible diaphragm 60, through compression delay element 110, thus compressing it and advancing liquid through dispenser 10, as described. Compression delay element 110 gives under the initial pressure and thus serves to delay the collapsing of flexible diaphragm 60 relative to the movement of piston 40. This causes a small amount of air to be moved before any liquid is advanced, and the air so moved will build up pressure due to the resistances to its movement through the small clearances throughout the air path and the resistance to movement of the air through inlet mesh 100. Thus, when liquid is moved upon adequate displacement of dual actuator 104 both the liquid and air enter mixing chamber 98 under pressure to create a high quality foam product. If the air path was not pre-pressurized prior to the liquid advancing then the foam product would be very wet at the beginning of dispense.

Upon the release of pressure pushing down on dual actuator 104, biasing member 48, flexible diaphragm 60, and compression delay element 110 all serve to aid the system in reverting back to its normal rest position. Compressible air chamber 18 and compressible liquid chamber 52 expand, with liquid being drawn up dip tube 76 into compressible liquid chamber 52, and air being drawn down from the outlet through mixing chamber 98 and annular air dispensing tube 96, ultimately back into compressible air chamber 18. This movement of air through the outlet back into the system can help prevent dripping at outlet 80.

It should be appreciated that the dispenser 10 shown in the drawings is particularly useful in a counter mounted environment, but the general structures and concepts disclosed herein could be applied to hand held dispensers and wall mounted dispensers. In a hand held embodiment, the dispenser 10 would simply be constructed with the structural elements disclosed for dispenser 10, with those elements constructed so as to produce a sleek external appearance and facilitate plunger actuation. In a wall mounted environment, the structural elements could again be readily adapted to fit within common wall mounted housings.

In a counter mount embodiment, cap 118 threads onto threaded neck 20 to press upper radial flange 22 against gasket 24, and thus helps to secure the mechanics of dispenser 10. A keyed overcap 130, also with a cut-out portion for elbow 86, fits over cap 118 and serves as a means for securing the combination container 12, associated compressible liquid and air chambers 52, 18, elbow 86 and dispensing tube 46 to bottle support 14, as described in copending US Published Patent Application No. 2007/0017932.

Figure 8:
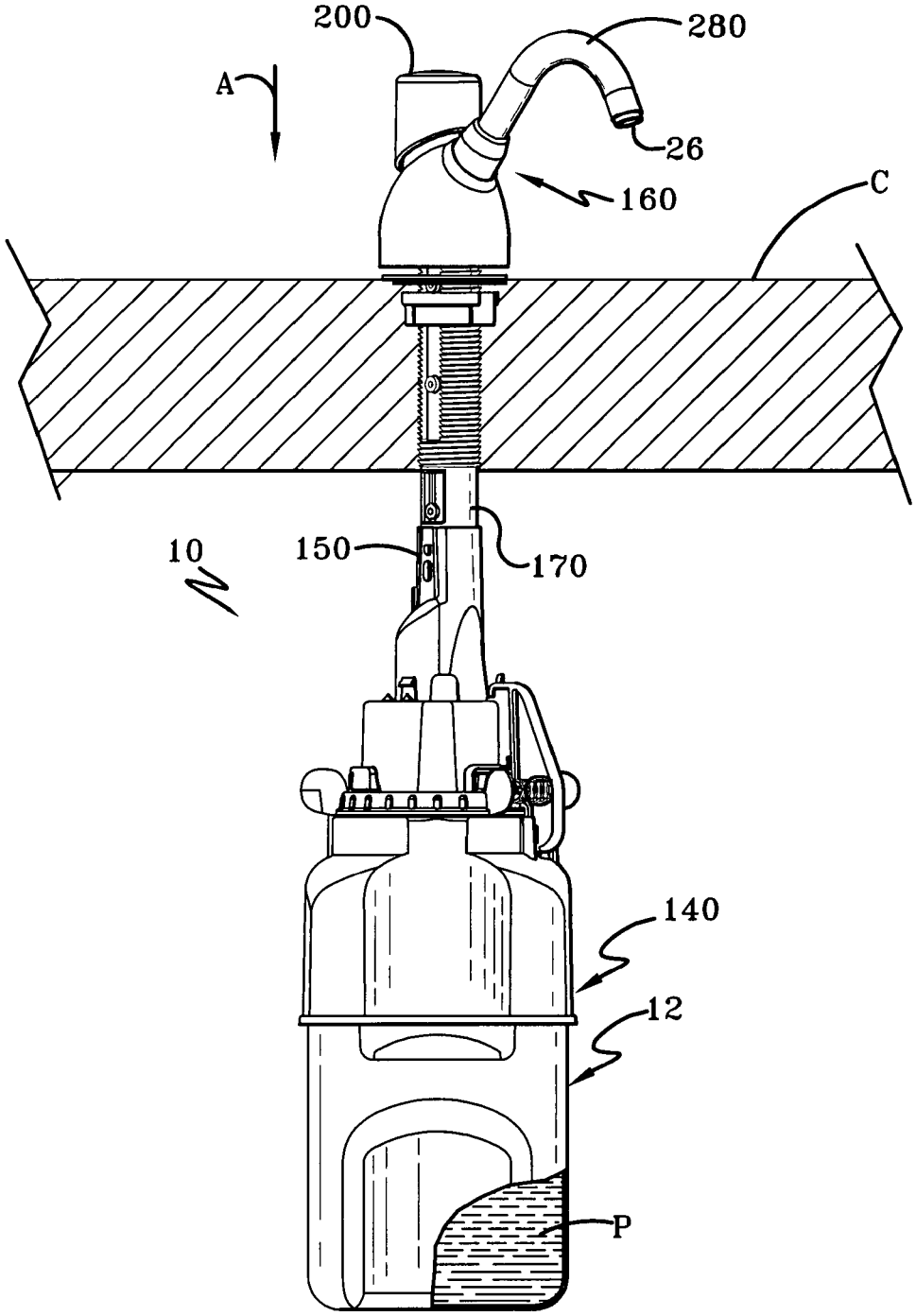
FIG. 8 is a general representation of the dispenser shown in a counter mount environment.

The counter mounted dispenser 10 is shown in FIG. 8. Container 12 is preferably received in bottle support 140, and dispensing head 160 is secured to bottle support 140 at connector 150, preferably without the need for rotating bottle support 140 relative to head 160. An extension 170 of head 160 telescopes into connector 150 until apertures (not shown) in extension 170 align with apertures in connector 150 to permit a lock pin to be inserted therethrough to hold bottle support 140 and associated container 12 to extension 170 and dispensing head 160. Foam pump mechanism 14 is secured to container 12 and actuated by the depression of plunger 200 to dispense product P at the outlet 80 of spout 280. Extension 170 and bottle support 140 permit the passage of shaft 132 (see FIG. 2, where shaft 132 is shown in ghost to reflect that it is only particularly applicable in a non hand held environment), which extends from association with plunger 200 to engage top wall 108 of dual actuator 104, and the passage of the dispensing tube 46 for carrying product from container 12 to the outlet 80 of spout 280.

In an electronically activated system, plunger 200 would be replaced with a hands-free activation means, such as a sensor that, when tripped, activates electronic means to move gearing mechanisms to advance shaft 132 to compress the compressible air and liquid chambers 18, 52. The electronic means would also permit the shaft to cycle back to its rest position, thus putting the system in a state ready for a subsequent actuation.

In accordance with the foregoing, in particular embodiments of this invention, the product P is a liquid that is capable of foaming when mixed with air, and the product P is particularly chosen from a foamable skin care or skin sanitizing product. However, this invention is not limited to the dispensing of such products, particularly because it will be readily appreciated that the proposed dispensers herein could be employed for other products.

In light of the foregoing, it should thus be evident that the present invention provides a dispensing system that substantially improves the art. In accordance with the patent statutes, only the preferred embodiments of the present invention have been described in detail hereinabove, but this invention is not to be limited thereto or thereby. Rather, the scope of the invention shall include all modifications and variations that fall within the scope of the attached claims.

We claim:

1. An under counter mount dispenser comprising:

a container for holding a foamable liquid;

the container having a neck portion and an opening at the top of the neck portion;

a pump housing having a mounting member for mounting the pump housing below a countertop and a connecting member for connecting to the container;

a compressible air pump and a compressible liquid pump located above an upper liquid level of the container when the container is filled with the foamable liquid; and wherein the compressible liquid pump is configured to draw the foamable liquid up from the container;

a stationary dispensing tube in communication with an outlet of the liquid pump and an outlet of the air pump;

a mixing chamber configured to be located above the countertop in communication with the stationary dispensing tube;

the stationary dispensing tube having a first passageway for providing passage of the foamable liquid to the mixing chamber, and a second passageway for providing passage of air to the mixing chamber;

wherein the air and foamable liquid can be mixed in the mixing chamber to form a mixture;

a foaming member located proximate the mixing chamber for receiving the mixture; and an outlet for dispensing the mixture in the form of a foam.

2. The dispenser of claim 1 wherein the stationary dispensing tube is a bilumen.

3. The dispenser of claim 1 wherein the stationary dispensing tube is coaxial.

4. The dispenser of claim 3 wherein the second passageway surrounds the first passageway.

5. The dispenser of claim 1 further comprising a foam generator located proximate the mixing chamber.

6. An under counter mount dispenser comprising:

a container for holding a foamable liquid;

a container support for securing the container below a countertop;

the container having a neck, the neck having a center point;

an air pump located proximate the neck of the container, the air pump having a center point;

a liquid pump located proximate the neck of the container, the liquid pump having a center point;

wherein the center point of the neck, the center point of the air pump and the center point of the liquid pump are arranged along a longitudinal axis;

a liquid dispense tube in fluid communication with the liquid pump, the liquid dispense tube off-set from the longitudinal axis;

a liquid dip tube extending from the liquid pump to proximate the bottom of the container;

an air dispense tube in fluid communication with the air pump, the air dispense tube off-set from the longitudinal axis;

a mixing chamber configured to be located above the countertop in fluid communication with the liquid dispense tube and the air dispense tube;

a foaming member located proximate the mixing chamber for receiving the mixture; and an outlet in fluid communication with the mixing chamber.

7. The under counter mount dispenser of claim 6 wherein the inlet to the air dispense tube is located above the air pump.

8. The under counter mount dispenser of claim 6 wherein the inlet to the liquid dispense tube is located below the liquid pump.

9. The under counter mount dispenser of claim 6 wherein the inlet to the air dispense tube is located below the liquid pump.

10. The under counter mount dispenser of claim 6 wherein the liquid dispense tube and the air dispense tube are stationary with respect to the container.

11. The under counter mount dispenser of claim 6 wherein the liquid dispense tube and the air dispense tube are coaxial.

12. The under counter mount dispenser of claim 6 wherein the air dispense tube at least partially surrounds the liquid dispense tube.

13. A refill unit for an under counter mount dispenser comprising:

a container for holding a foamable liquid;

the container having a neck portion;

a foam pump secured to the neck portion;

the foam pump having a liquid pump portion and an air pump portion;

an engagement member for connecting to container support for mounting the container under a counter top;

the foam pump having a liquid outlet and an air outlet;

a first dispense tube secured to the liquid outlet;

a second tube secured to the air outlet;

the first and second dispense tubes extending upward from the foam pump;

a first end of the first and second dispense tubes being offset from a center of the foam pump;

a mixing chamber located proximate a second end of the first and second dispense tubes;

an outlet located downstream of the mixing chamber; and a liquid dip tube extending from the foam pump down into the container;

wherein when the refill unit is installed, the container is located under a countertop and the mixing chamber is located above the countertop.

14. The refill unit of claim 13 wherein the first and second dispense tubes are coaxial.

15. The refill unit of claim 14 wherein the second dispense tube at least partially surrounds the first dispense tube.

16. The refill unit of claim 14 wherein the air pump is a piston pump.

17. The refill unit of claim 14 wherein the engagement member is a keyed overcap.

18. The refill unit of claim 14 wherein liquid leaving the liquid pump flows along a passage that is substantially normal to the liquid dispense tube prior to entering the liquid dispense tube.

19. The refill unit of claim 14 wherein air leaving the air pump flows along a passage that is substantially normal to the air dispense tube prior to entering the air dispense tube.

20. The refill unit of claim 14 wherein air flows into and out of the air pump through the air dispense tube.

* * * * *